US007110014B2

(12) United States Patent
Mizutani

(10) Patent No.: US 7,110,014 B2
(45) Date of Patent: Sep. 19, 2006

(54) IMAGE FORMING APPARATUS

(75) Inventor: Minoru Mizutani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 174 days.

(21) Appl. No.: 10/648,020

(22) Filed: Aug. 26, 2003

(65) Prior Publication Data

US 2004/0042818 A1 Mar. 4, 2004

(30) Foreign Application Priority Data

Aug. 27, 2002 (JP) ..... 2002-246558

(51) Int. Cl.
*B41J 2/385* (2006.01)

(52) U.S. Cl. ..... 347/140; 347/157; 347/158

(58) Field of Classification Search ..... 399/110, 399/228, 119; 347/110, 140, 157, 158
See application file for complete search history.

(56) References Cited

U.S. PATENT DOCUMENTS 5,541,720 A * 7/1996 Haneda ..... 399/228

2003/0053819 A1* 3/2003 Nomura et al. ..... 399/110

* cited by examiner

*Primary Examiner*—Stephen Meier
*Assistant Examiner*—Lam Nguyen
(74) *Attorney, Agent, or Firm*—Akin Gump Strauss Hauer & Feld, LLP

(57) ABSTRACT

An image forming apparatus includes a plurality of removable developing units each of which has an image carrier whose width is narrower than a width of a printable area of the printing paper, and a driving unit for driving the plurality of the removable developing units. The plurality of the removable developing units are disposed in different rows parallel to a main scanning direction such that one end of an image producing area of an image carrier of a first developing unit coincides with one end of an image producing area of an image carrier of a second developing unit adjoining to the first developing unit. The image forming apparatus further includes a control unit for supplying printing data to the plurality of the removable developing units in timings shifted form row to row.

10 Claims, 18 Drawing Sheets

IMAGE FORMING APPARATUS

FIELD OF THE INVENTION

The present invention relates to an image forming apparatus capable of forming an image having a width of a printable area of the printing paper by use of a plurality of developing units each having an image carrier whose width is narrower than the width of the printable area of the printing paper.

BACKGROUND OF THE INVENTION

There has been a great demand for image forming apparatuses such as printers supporting A4-size printing in portrait orientation. Printers that support A4-size printing in landscape orientation (or A3-size printing in portrait orientation) have also been in great demand. Recently, printers that support printing on large-size printing paper of A2 size or larger are now in increasing demand. In order to support printing on the large-size printing paper, the printers need, as an image carrier, a photoconductive drum having a width larger than the width of the printable area of the large-size printing paper. However, such a large-size photoconductive drum is exceedingly expensive compared with an A4-size or A3-size photoconductive drum. Consequently, conventional photoconductive drums whose widths are larger than the width of the printable area of the large-size printing paper as well as conventional image forming apparatuses having such a large-size photoconductive drum to support printing on the large-size printing paper are gaining little market acceptance.

SUMMARY OF THE INVENTION

The present invention has been made in order to solve the above-described problem with an object of providing an image forming apparatus capable of forming an image having a width of a printable area of a printing media by use of a plurality of developing units each having an image carrier whose width is narrower than the width of the printable area of the printing media.

This object is achieved by an image forming apparatus comprising:

a plurality of removable developing units each of which has an image carrier whose width is narrower than a width of a printable area of a printing medium;

a driving unit for driving the plurality of the removable developing units;

the plurality of the removable developing units being disposed in different rows parallel to a main scanning direction such that one end of an image producing area of an image carrier of a first developing unit coincides with one end of an image producing area of an image carrier of a second developing unit adjoining to the first developing unit;

the image forming apparatus further comprising a control unit for supplying printing data to the plurality of the removable developing units in timings shifted form row to row.

The image producing area of the image carrier of the first developing unit and the image producing area of the image carrier of the second developing unit adjoining to the first developing unit may overlap partially with each other

BRIEF DESCRIPTION OF THE DRAWINGS

Embodiments of the invention will now be described by way of example and with reference to the accompanying drawings in which:

FIG. 5(*b*) shows a bottom of the developing-unit guide of the image forming apparatus of the first embodiment;

FIG. 7(*b*) is a fragmentary side view of the exposing part 15;

DESCRIPTION OF THE PREFERRED EMBODIMENTS

A FIRST EMBODIMENT

A printer of a first embodiment according to the invention includes a plurality of developing units arranged in a main scanning direction (cross feed direction) each having an A4-size photoconductive drum of a width smaller than the width of the printable area of the large-size printing paper of A0 or A1 size for example, and a driving section for driving each of the driving units. Printing data for performing printing on the large-size printing paper of A0 or A1 size for example are divided into as many blocks as there are the developing units. By transmitting the divided data to the developing units and driving each of them, it is possible to perform printing on the large-size printing paper.

Figure 1:
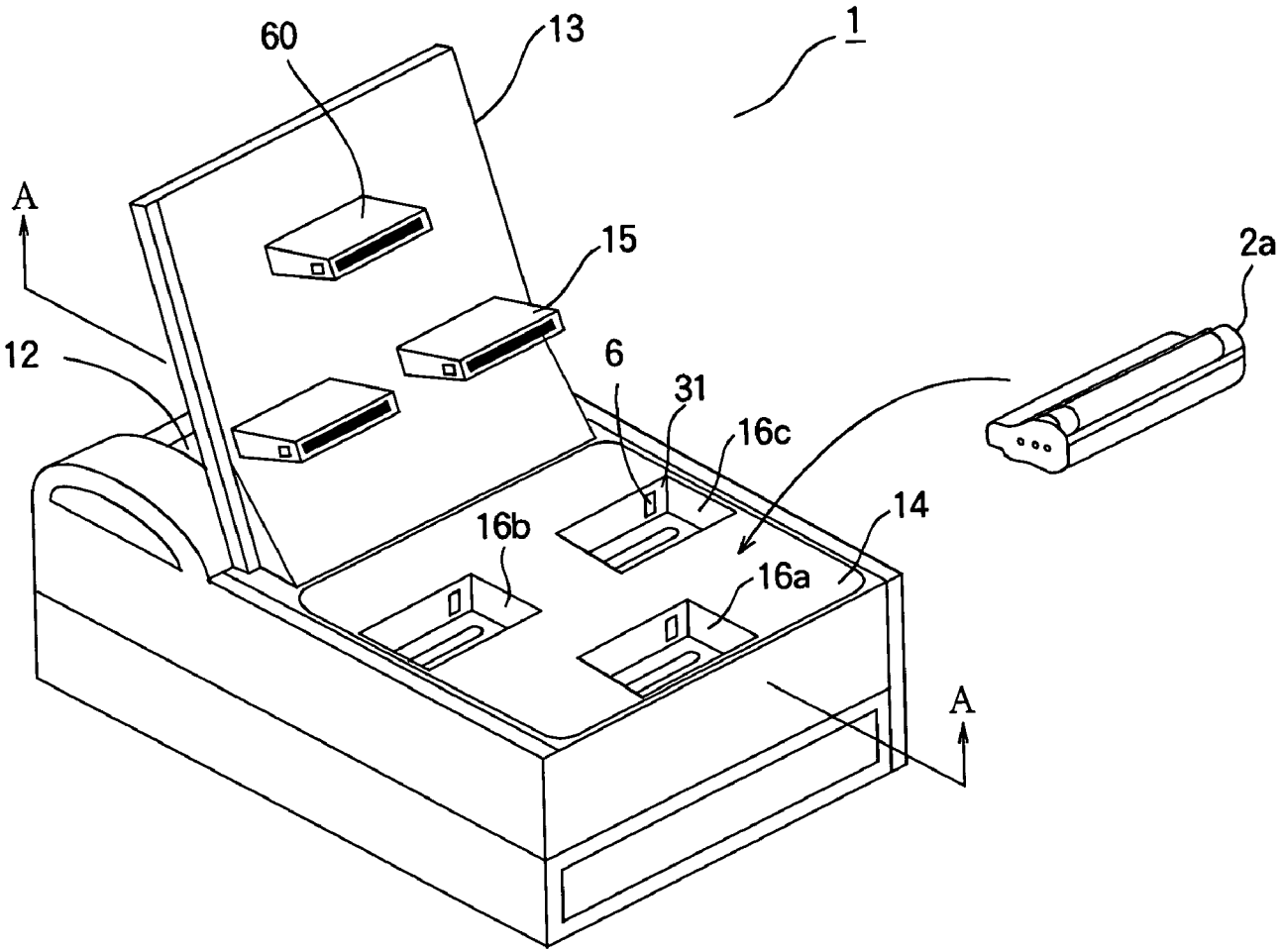
FIG. 1 is a perspective view of an image forming apparatus of a first embodiment according to the invention.
Figure 2:
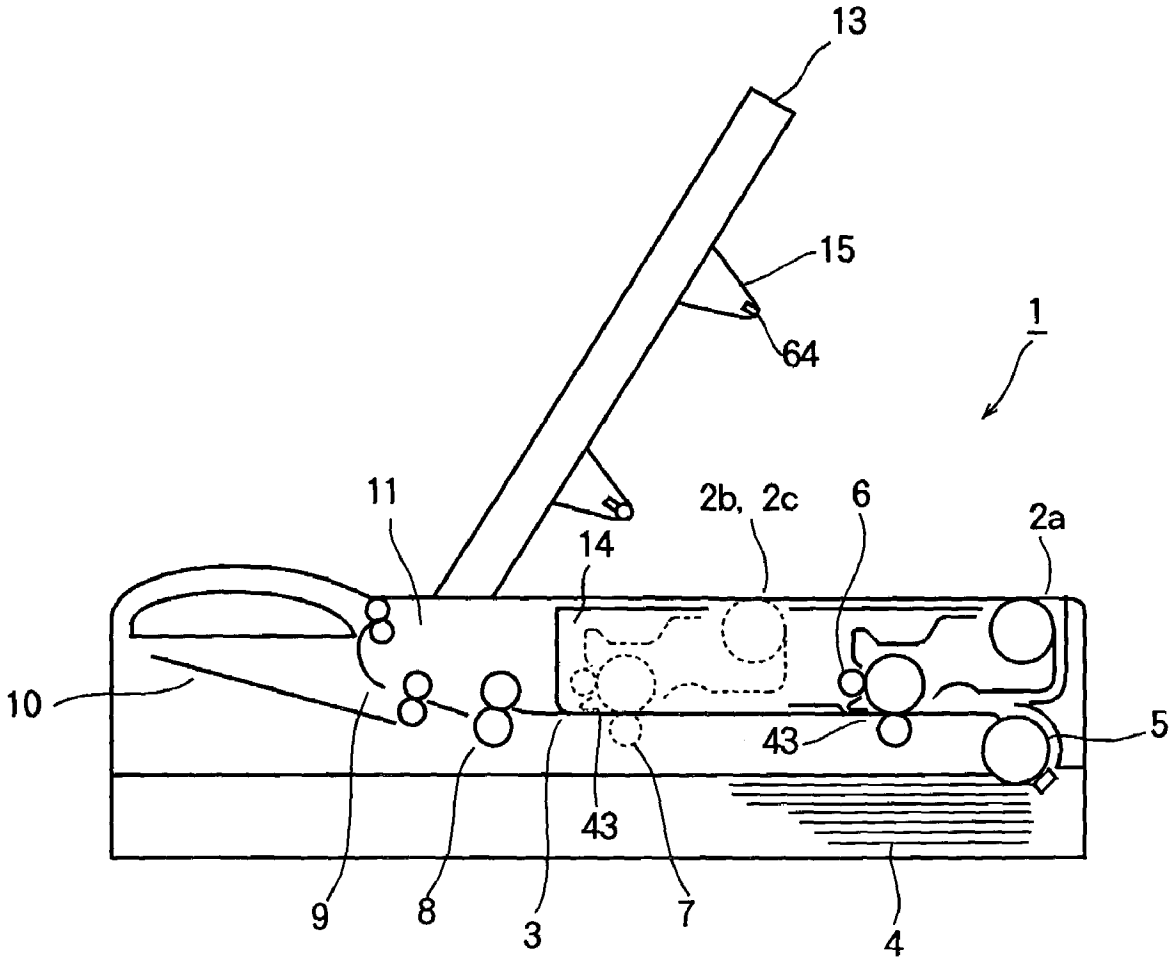
FIG. 2 is a cross sectional view of the mage forming apparatus of the first embodiment.

FIG. 1 is a perspective view of the printer 1 of the first embodiment according to the invention. FIG. 2 is an A—A cross section of the printer 1 shown in FIG. 1. In FIG. 2 shown are developing units 2*a*, 2*b* disposed above a paper-transporting passageway 3. These developing units are in a staggered configuration as shown in FIG. 1. Each of the developing units has an A4-size photoconductive drum whose total width is 230 mm. The width of the toner image producing area of this photoconductive drum is 210 mm to allow printing on the A4-size printing paper having the width of 210 mm in portrait orientation. Using four such A4-size photoconductive drums disposed side-by-side such that the edges of the toner image producing areas of neighboring photoconductive drums coincide with each other makes it possible to perform printing on A0-size printing paper having the width of 840 mm. If it is difficult to dispose them as described-above, they may be disposed such that the toner image producing areas of neighboring photoconductive drums overlap partially, though five A4-size photoconductive drums are required in this case. By increasing the number of the photoconductive drums placed side-by-side, it becomes possible to perform printing on any size of printing paper larger than A0. In order to facilitate the understanding and explanation of the invention, the printer 1 of the first embodiment will be described supposing that it has three developing units so as to be capable of printing on A1-size printing paper.

As shown in FIG. 1 and FIG. 2, the printer 1 includes a printing-paper storage 4, a printing-paper feeding section 5, a paper-transporting passageway 3, developing units 2*a*, 2*b*, 2*c*, driving gears 6 for driving the developing units, transferring sections 7, a fixing section 8, a printing-paper discharging passageway 9, a face-up discharging section 10, a face-down discharging section 11, a display section 12, a printer cover 13, and a developing-unit guide 14. The developing-unit guide 14 has developing-unit storing recesses 16*a*, 16*b*, 16*c*. A plurality of exposing sections 15 each including an LED head 64 are provided on the back of the printer cover 13 such that they are in a one-to-one positional correspondence with the plurality of the developing units.

The printing operation of this printer 1 is explained below. The printing paper is fed one by one from the printing-paper storage 4 to the paper-transporting passageway 3 underneath the bottom of the developing-unit guide 14 by the printing-paper feeding section 5. The toner image formed by the developing units 2 within the developing-unit guide 14 is transferred to the printing paper by the transferring sections 7 disposed opposite their respective developing units. Then, the printing paper bearing the toner image is transported the fixing section 8, where the toner image is fixed. The printing paper bearing the fixed toner image passes through the printing-paper discharging passageway 9 and is discharged to the printing-paper discharging sections 10, 11.

It is preferable to use large-size rollers for a hopping roller of the printing-paper feeding section 5, transferring rollers of the transferring sections 7, and a fixing roller of the fixing section 8 for preventing the large-size printing paper becoming wrinkled while it is transported.

Figure 3:
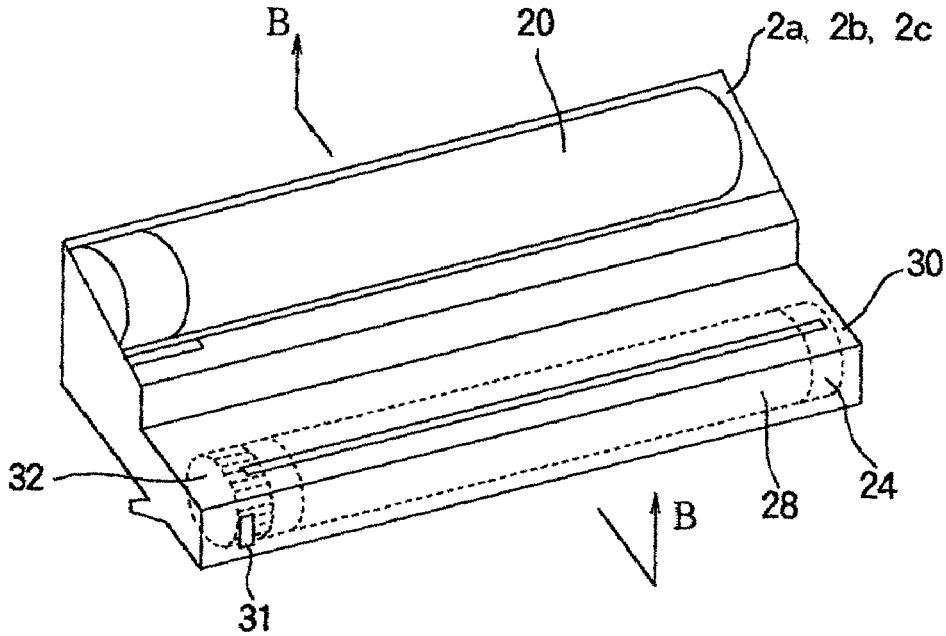
FIG. 3 is a perspective view of a developing unit for use in the image forming apparatus of the first embodiment.
Figure 4:
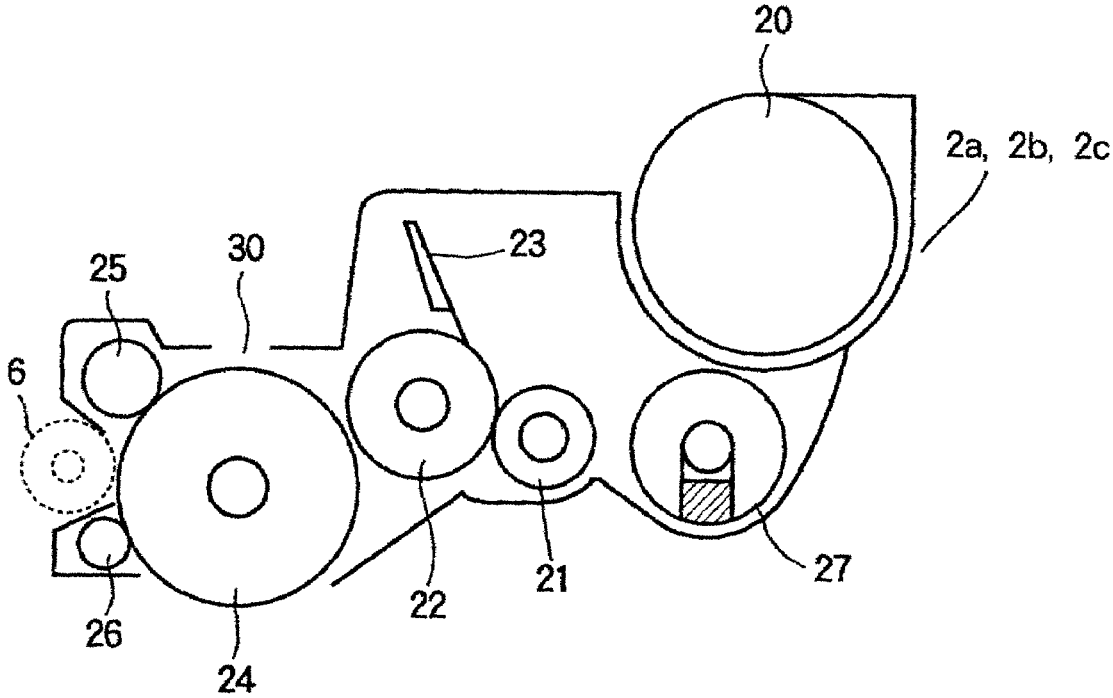
FIG. 4 is a cross sectional view of the developing unit for use in the image forming apparatus of the first embodiment.

FIG. 3 is a partially perspective view of the developing unit 2 stored in the developing-unit guide 14. FIG. 4 shows a B—B section of the developing unit 2 shown in FIG. 3. In FIG. 3, 30 denotes an exposing-beam receiving slit, 20 denotes a toner cartridge, 31 denotes a driving-gear-admission opening, 24 denotes a photoconductive drum, 32 denotes a photoconductive-drum gear, and 28 denotes a toner image producing area on the surface of the photoconductive drum 24 in which a toner image can be produced. In FIG. 4, 25 denotes a charging section including a charging roller, 26 denotes a cleaning section including a cleaning roller or a cleaning blade, 22 denotes a toner carrier including a developing roller, 21 denotes a toner supplying section including a toner supplying roller, 23 denotes a toner-layer-thickness regulating section 23 including a blade, and 27 denotes a toner agitating section. The driving gear 6 shown in FIG. 4 is provided within the developing-unit guide 14. When the printer cover 13 is closed down, the LED heads 64 of the exposing sections 15 provided on the back of the printer cover 13 engage with the exposing-beam receiving slits 30. Generally, a toner image is not formed so as to stretch throughout the width of the photoconductive drum 24. The photoconductive drum 24 has some margins at both edges thereof between which the toner image producing area 28 is formed.

Figure 5:
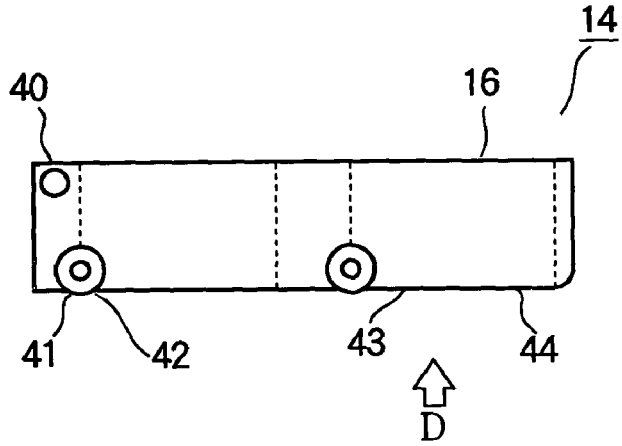
FIG. 5(*a*) shows a cross section of a developing-unit guide of the image forming apparatus of the first embodiment.
Figure 5:
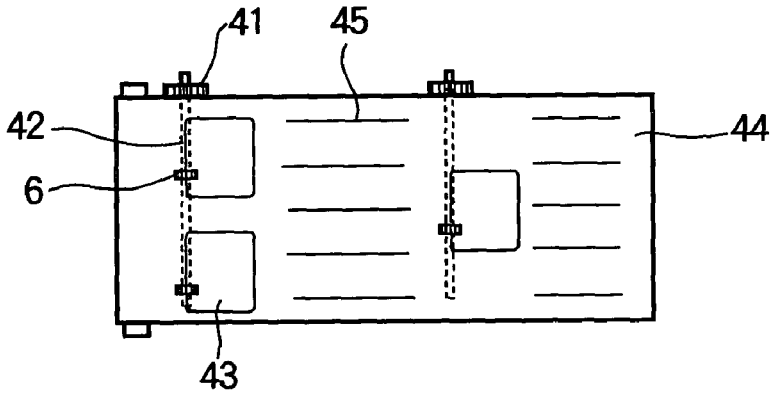

FIG. 5(*a*) is a side view of the developing-unit guide 14. FIG. 5(*b*) is a bottom plan view of the developing-unit guide 14 when it is viewed in the direction of the arrow D shown in FIG. 5(*a*). The developing-unit guide 14 includes a gear 41, a gear shaft 42, a photoconductive-drum outshoot opening 43, a bottom plate 44 and bottom-plate ribs 45. The gear 41 engages with an after-described transmission gear 52 when the developing-unit guide 14 is set in the printer 1. As the gear 41 rotates, the gear shaft 42 rotates and accordingly the driving gear 6 rotates. In consequence, the photoconductive drum 24 engaged with the driving gear 6 rotates. The photoconductive-drum outshoot opening 43 is formed at the bottom of each of the developing-unit storing recesses 16*a*, 16*b*, 16*c* of the developing-unit guide 14. As shown in FIG. 2, when the developing units 2*a*, 2*b*, 2*c* are set in the developing-unit storing recesses 16*a*, 16*b*, 16*c*, the photoconductive drums 24 outshoot from the photoconductive-drum outshoot opening 43. The photoconductive drums 24 outshooting from the photoconductive-drum outshoot openings 43 face the paper-transporting passageway 3.

The bottom-plate ribs 45 provided on the bottom plate 44 of the developing-unit guide 14 extend in a direction parallel to the direction in which the printing paper is transported. The bottom plate 44 serves as a part of the paper-transporting passageway. The bottom-plate ribs 45 reduce the friction between the printing paper being transported and the paper-transporting passageway.

Figure 6:
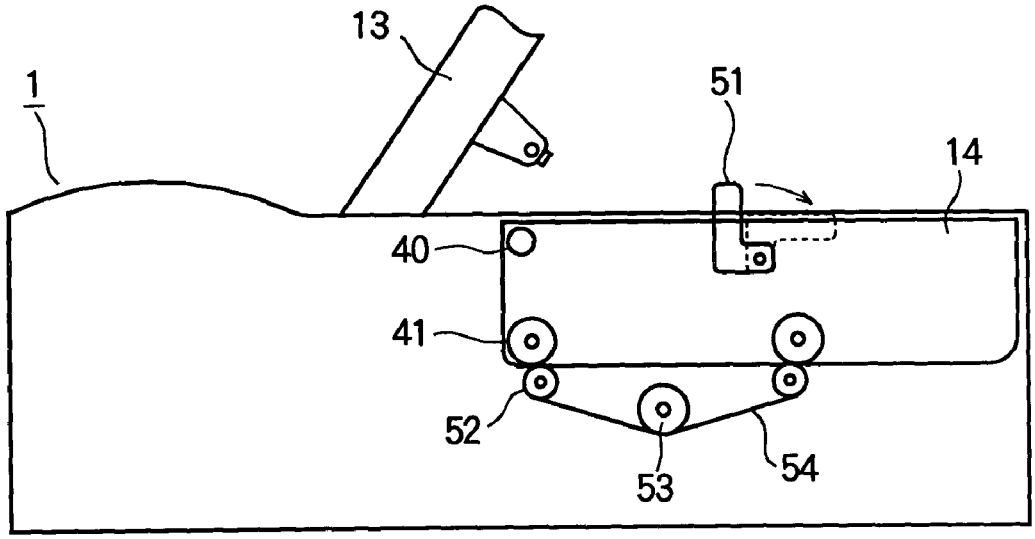
FIG. 6 is an explanatory view explaining how the driving force is transmitted to the developing-unit guide when it is set in image forming apparatus of the first embodiment.

FIG. 6 is an explanatory view explaining how the driving force is transmitted to the developing-unit guide 14 when it is set in the printer 1. The printer 1 is provided with the transmission gear 52, a driving roller 53 and a belt 54 for transmitting the driving force from a not illustrated motor within the printer 1 to the driving roller 53. The driving force transmitted to the driving roller 53 is transmitted to the transmission gear 52 via the belt 53, and further transmitted to the gear 41 of the developing-unit guide 14.

The developing-unit guide 14 is provided with a handle 51 as shown in FIG. 6, so that the developing-unit guide 14 can be held and lifted out of the printer 1. The handle 51 is retractable as shown by the dotted line in FIG. 6. Alternatively, the top plate of the developing-unit guide 14 may be openable and closable like the printer cover 13 by making the top plate turnable around a pivot 40 provided in the vicinity of one end of the top plate. Such structures allowing the developing units 2 to be lifted all at once makes it possible to remove the jammed paper below the developing-unit guide 14 easily.

Figure 7:
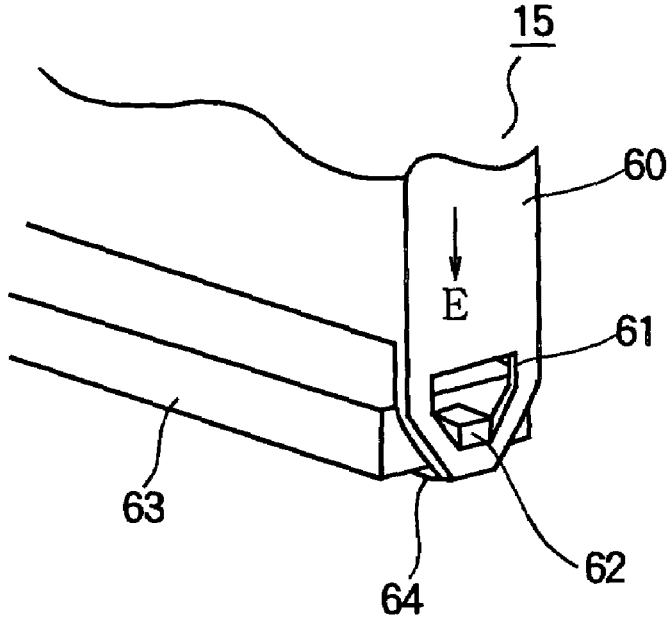
FIG. 7(*a*) is a fragmentary perspective view of an exposing section (LED head) of the image forming apparatus of the first embodiment.
Figure 7:
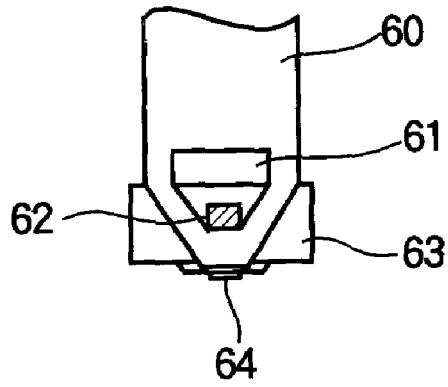

FIG. 7(*a*) is a fragmentary perspective view of the exposing section 15, and FIG. 7(*b*) is a fragmentary side view of the exposing section 15. The LED heads of the exposing sections 15 are of small size, for example A4 size as is the photoconductive drum, and accordingly their width is smaller than the width of the printable area of the printing paper of A0 size or A1 size. As shown in FIG. 7, the exposing section 15 includes an LED-head holding part 60, LED-head positioning holes 61, an LED-head substrate 63, projections 62 integral with the substrate 63, and the LED head 64.

The LED-head holding part 60 is provided on the back of the printer cover 13 as shown in FIG. 1. The projections 62 integral with the LED-head substrate 63 are inserted into the LED-head positioning holes 61. As shown in FIG. 7, the LED-head positioning hole 61 has a broadened upper part and a narrowed lower part. The broadened part and the narrowed part are connected by a tapered part. The LED-head substrate 63 is urged in the direction shown by the arrow E by a not illustrated spring provided in the LED-head holding part 60 so that each of the projections 62 integral with the LED-head substrate 63 is pressed against the edge the narrowed lower part of the LED-head positioning hole 61, thereby positioning the LED head 64.

The printer 1 of the first embodiment capable of printing an image on the large-size printing paper can be provided at low cost, since it has a plurality of developing units of small size whose width is narrower than that of the printable area of the large-size printing paper instead of a single expensive large-size developing unit, and has, for its exposing section, a plurality of LED heads of small size whose width is narrower than that of the printable area of the large-size printing paper instead of a single expensive large-size LED head.

Although LED heads are used for the exposing section in this first embodiment, different types of beam sources e.g. lasers may be used.

Figure 8:
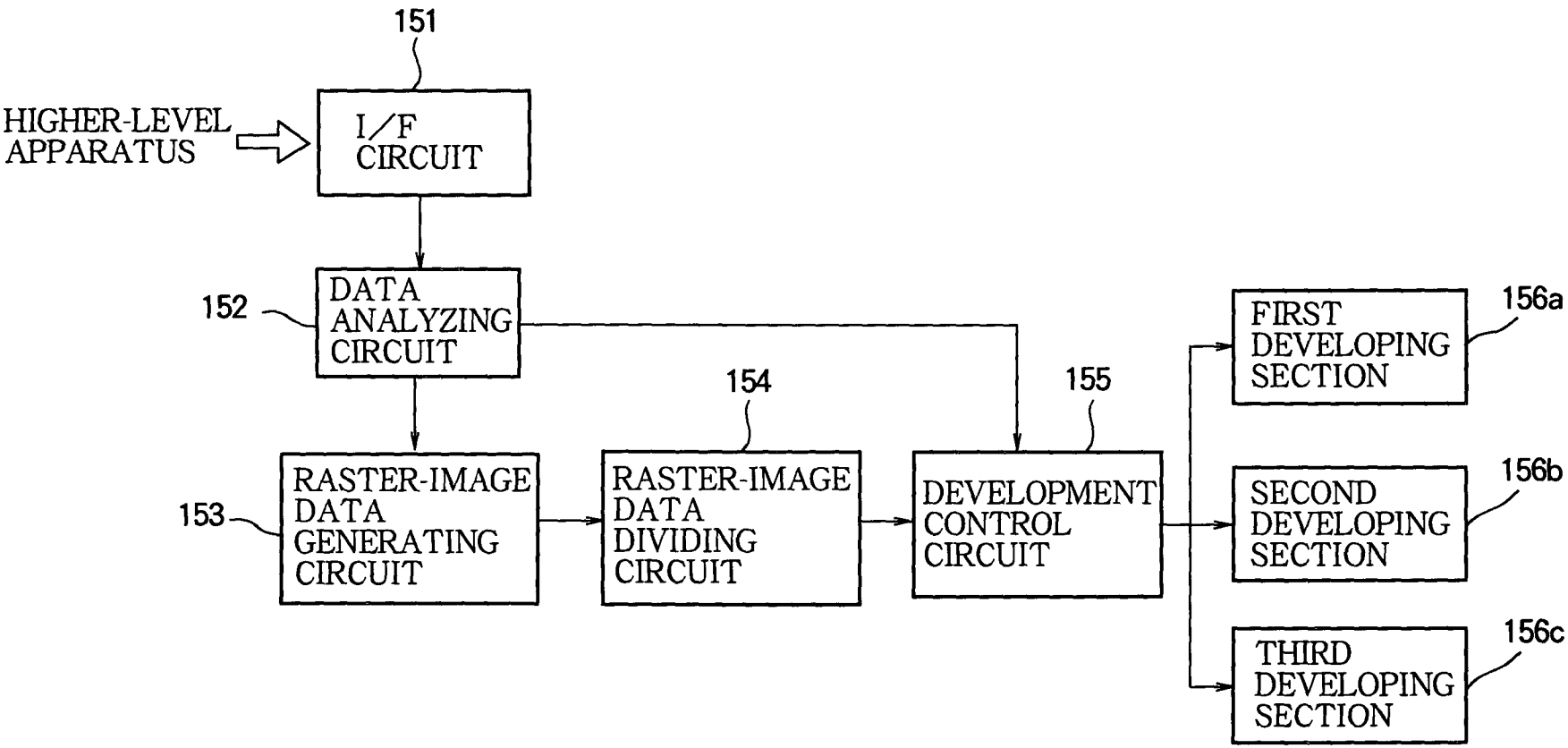
FIG. 8 is a block diagram showing the circuitry of the image forming apparatus of the first embodiment.

FIG. 8 is a block diagram showing the circuitry of the printer 1 of the first embodiment. As shown in FIG. 8, the printer 1 includes an I/F circuit 151 for transmission and reception of data with the outside, a data-analyzing circuit 152 for analyzing received data to obtain paper-size information or color information etc, a raster-image data generating circuit 153 for generating raster-image data from the received data, a raster-image data dividing circuit 154 for dividing the generated raster image into three pieces of raster-image data to be supplied to the three developing units, first, second and third developing sections 156*a*, 156*b*, 156*c* of these developing units for forming an image based on the received data, and a development control circuit 155 for controlling the operations of the developing sections 156*a*, 156*b*, 156*c* and the timing of the raster-image data transference to the developing sections 156*a*, 156*b*, 156*c*.

The I/F circuit 151 receives data from a higher-level apparatus such as a host computer or a facsimile, and transmits data generated within this printer to the high-level apparatus.

The data analyzing circuit 152 analyzes the data sent from the higher-level apparatus to obtain information specified by this higher-level apparatus (paper-size information or color information etc.). The data analyzing circuit 152 outputs the received data and the result of the analysis to the raster-image generating circuit 153.

The raster-image data generating circuit 153 generates raster-image data from the received data referring to the information specified by the higher-level apparatus output from the data analyzing circuit 152, and stores this generated raster-image data in its raster image memory. In the case of receiving color data, the raster-image data is generated for each color on the basis of the color information. The size of the raster-image data is determined by the paper-size information.

Figure 10:
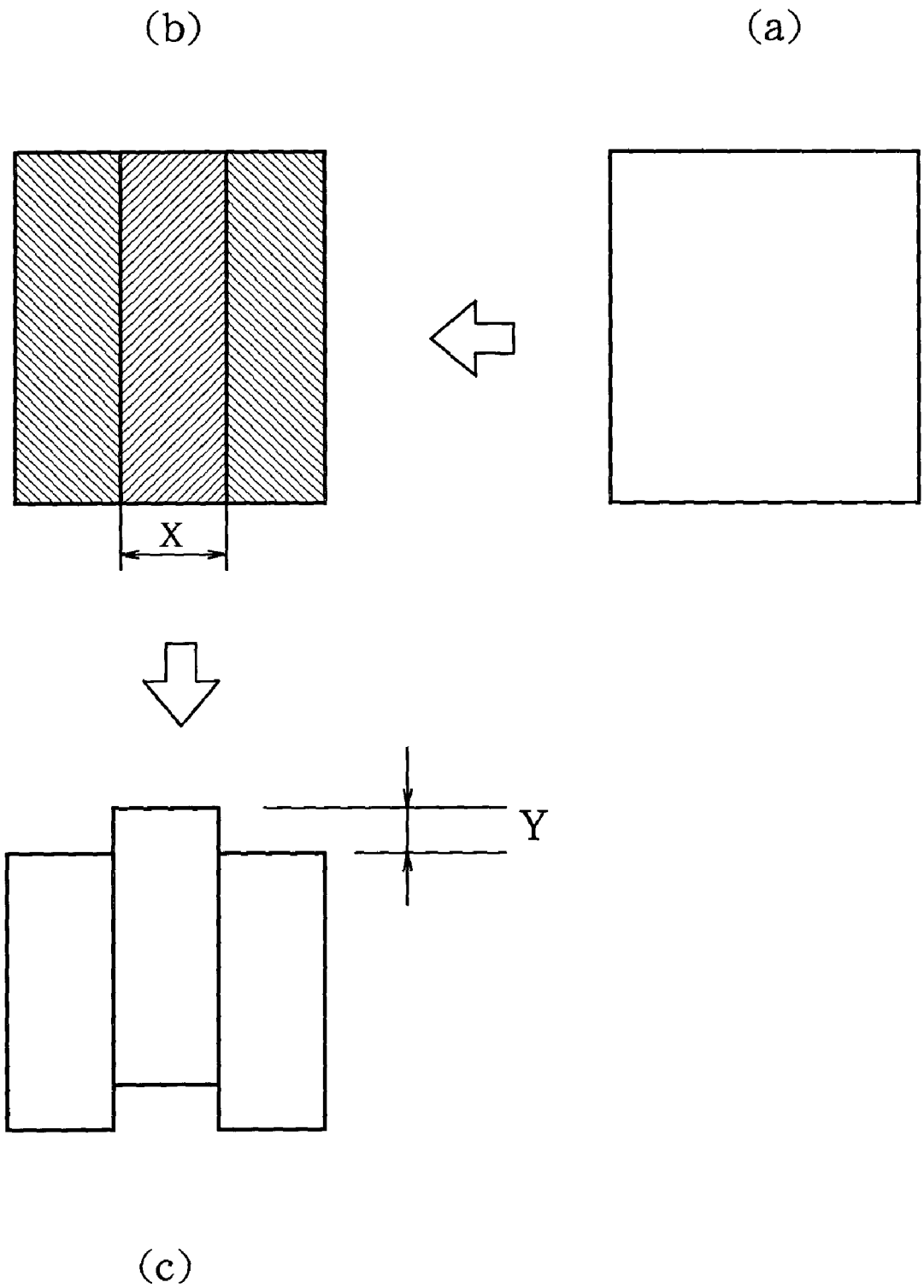
FIG. 10 is an explanatory view for explaining how the raster image data is stored in a memory in the image forming apparatus of the first embodiment.

The raster-image data dividing circuit 154 divides the raster-image data represented by (a) in FIG. 10 which is generated by the raster-image data generating circuit 153 into three pieces of raster-image data represented by (b) in FIG. 10 corresponding to the three developing units 2*a*, 2*b*, 2*c*. The width of the toner image producing area of the photoconductive drum is equal to X shown in FIG. 10. In the case of color data, the division of the raster-image data is performed for each color.

The development control circuit 155 initiates driving the developing units 2 and watching the position of the printing paper being transported upon receiving one page of the raster-image data. When detecting that the printing paper has been transported to a position in which the toner image forming operation is to be started, the development control circuit 155 transfers the divided raster-image data to the developing units. The timing of the raster-image data transference is represented by (c) in FIG. 10. The distance between the developing units in the printing paper transporting direction corresponds to a time difference Y shown in FIG. 10. The middle one of the three pieces of the divided raster-image data is transferred earlier by Y to the corresponding developing unit situated in the front of the printer 1 for the above distance.

The first, second and third developing sections 156*a*, 156*b*, 156*c* are driven under the control of the development control circuit 155, and forms a toner image on the photoconductive drums 24 in accordance with the raster-image data transferred form the development control circuit 155.

Although the division of the received data is carried out after the raster-image data is generated in this first embodiment, it is possible to perform the data division on an intermediate file (display list) to obtain a plurality of pieces of data to be supplied to a plurality of developing units before the raster-image data is generated.

Figure 9:
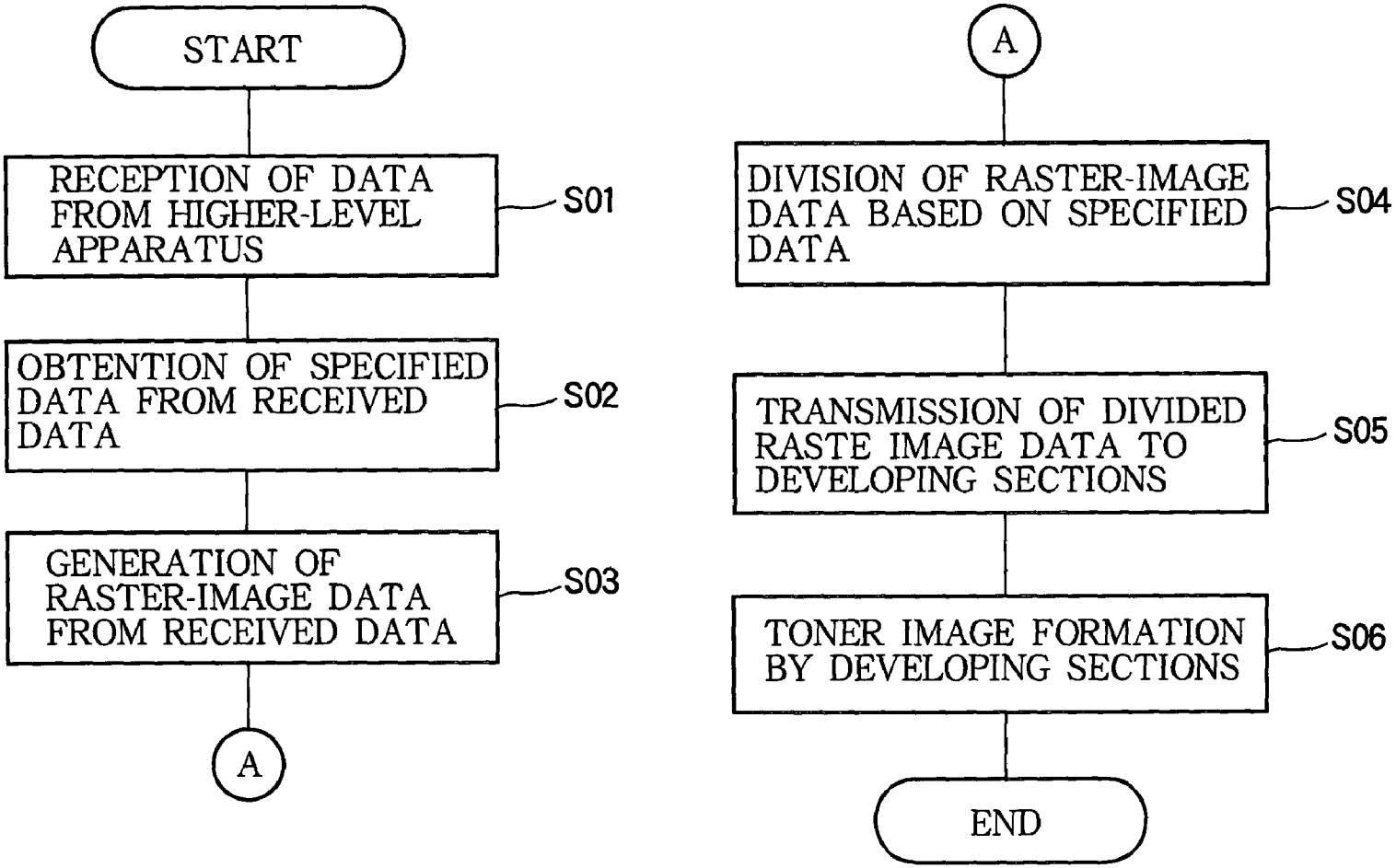
FIG. 9 is a flowchart for explaining the operation of the image forming apparatus of the first embodiment.

The operation of the printer 1 of the first embodiment will be explained with reference to the flowchart shown in FIG. 9.

In step S01, the I/F circuit 151 receives data sent from the higher-level apparatus at its reception buffer. The received data is read from the reception buffer and sent to the data analyzing circuit 152 in succession.

In step S02, the data analyzing circuit 152 analyzes the received data to detect specific information therefrom. The data analyzing circuit 152 forwards the received data to the raster-image data generating circuit 153, while storing the detected specific information in its memory. The specific information includes printing paper size information or color information for example. This stored specific information is used to generate the raster-image data of the printing paper size for each color.

In step S03, the raster-image data generating circuit 153 generates the raster-image data matching the specified paper size and stores it in the raster-image memory ((a) in FIG. 10). The raster-image data generating circuit 153 informs the raster-image data dividing circuit 154 of an address of the raster-image data in the raster-image memory.

In step S04, the raster-image data dividing circuit 154 divides the raster-image data generated by the raster-image data generating circuit 153 into three pieces of data ((b) in FIG. 10) to be supplied to the three developing units 2. Addresses of the divided data are stored in the memory as well.

The developing units 2 are arranged such that the edges of the toner image producing areas of the photoconductive drums 24 of the neighboring developing units coincide with each other so that an image formed by these developing units 2 does not have a blank area. Alternatively, they may be arranged such that the toner image producing areas of the photoconductive drums 24 of the neighboring developing units overlap partially.

The development control circuit 155 receives the addresses of the divided raster-image data in the memory.

In step S05, the development control circuit 155 initiates driving the developing units 2 and watching the position of the printing paper being transported. When detecting that the printing paper has been transported to a position in which the toner image forming operation is to be started, the development control circuit 155 transfers the divided raster-image data ((c) in FIG. 10) to the developing units 2.

In step S06, the developing units 2 form a toner image according to the supplied raster-image data on the photoconductive drums 24 and transfer it to the printing paper.

As described above, the printer 1 of the first embodiment according to the invention includes the plurality of the developing units 2 disposed in a main scanning direction (cross feed direction) each having the A-4 size photoconductive drum of the width smaller than the width of the printable area of the large-size printing paper of A0 or A1 size for example. By driving the developing units 2 through the driving gears 6, the image data of large size matching the large-size printing paper of A0 or A1 size for example can be printed. The printer of the first embodiment supporting the large-size printing paper can be provided at lower cost, since it does not require the expensive large-size photoconductive drum. In addition, the running cost (printing cost per one sheet of printing paper) of the printer of this embodiment is low since the unit price of its photoconductive drum as an consumable item is low.

A First Variant of the First Embodiment.

The first embodiment may have only two A4-size photoconductive drums in a staggered configuration to be capable of performing A3-size printing.

A Second Variant of the First Embodiment.

Figure 11:
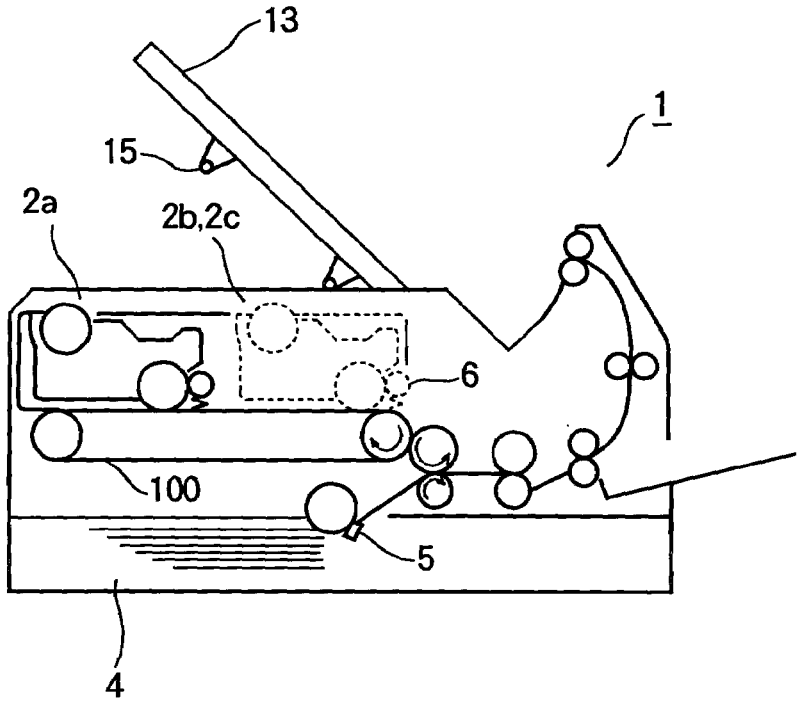
FIG. 11 is a cross sectional view of a variant of the image forming apparatus of the first embodiment.

The printer 1 of the first embodiment may be provided with an intermediate transferring mechanism using an intermediate transferring belt. In this variant of the first embodiment, the developing units 2 are arranged so as to face the intermediate transferring belt 100 as shown in FIG. 11. The developing units 2 of this variant are in a staggered configuration as with the first embodiment.

A SECOND EMBODIMENT

Figure 12:
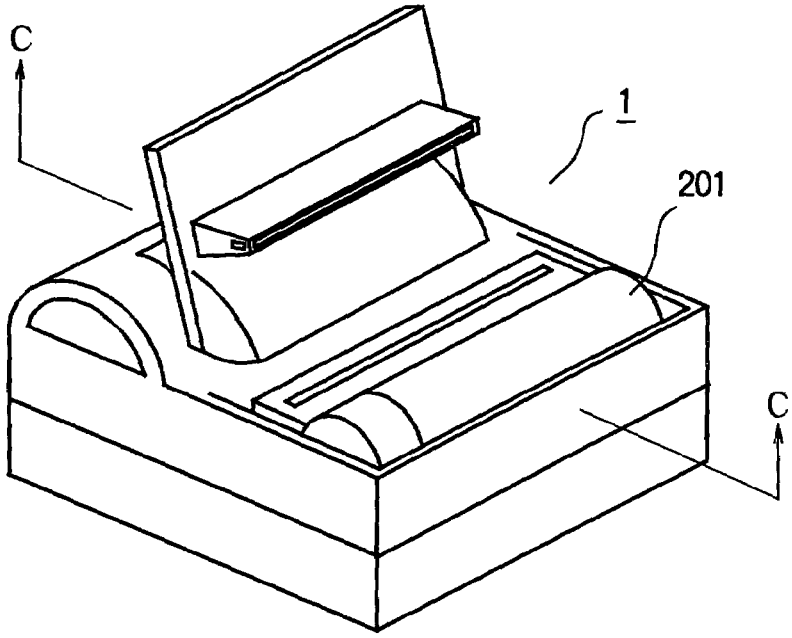
FIG. 12 is a perspective view of a conventional image forming apparatus.
Figure 13:
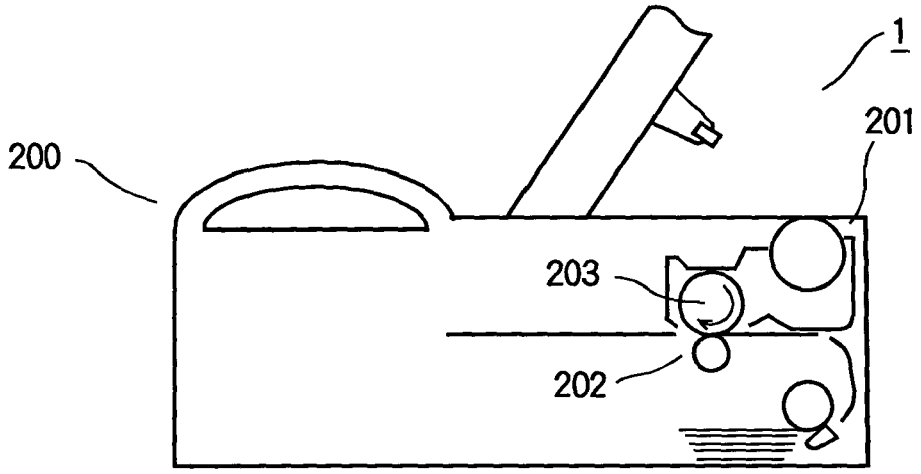
FIG. 13 is a cross sectional view of the conventional image forming apparatus.
Figure 14:
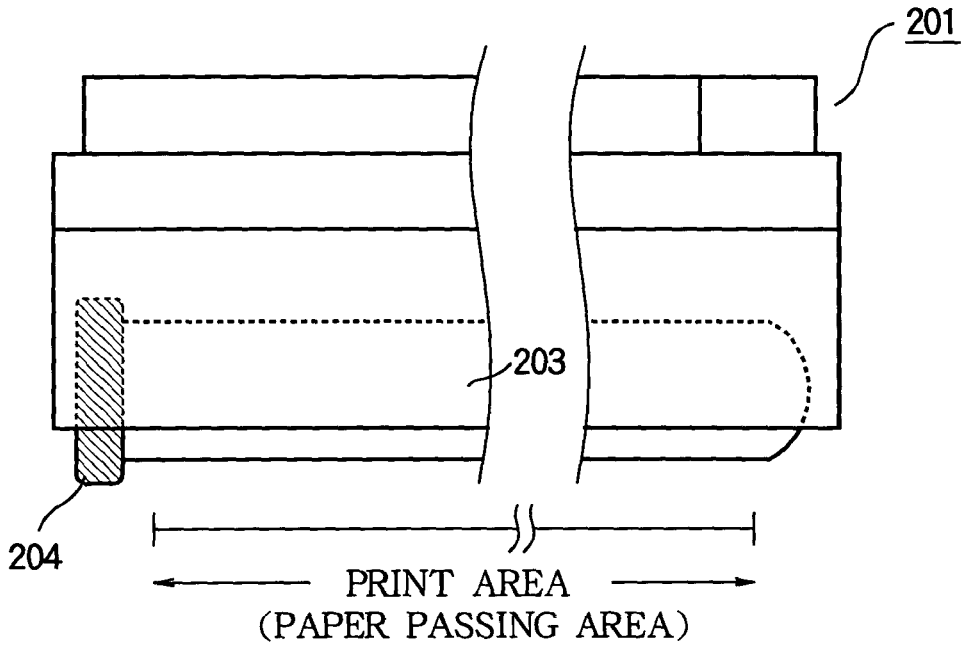
FIG. 14 shows a photoconductive drum included in a conventional developing unit.

The printer 1 of the first embodiment needs the developing units 2 whose geometry is different from that of a conventional developing unit. As explained with reference to FIGS. 3 and 4, the developing unit 2 has the driving-gear-admission opening 31 through which the driving gear 6 is inserted. To form such an opening, the layouts of the charging section 25 and the cleaning section 26 within the developing unit 2 have to be changed. Here, a structure of a conventional printer 200 is explained below with reference to FIGS. 12 to 14. FIG. 12 is a perspective view of the conventional printer 200, and FIG. 13 is a C—C cross section of the printer 200. FIG. 14 shows a conventional developing unit 201 set in the conventional printer 200. The developing unit 201 includes a photoconductive drum 203 one end of which a photoconductive-drum gear 204 is fixed to.

As shown in FIG. 12, the conventional printer 200 has only one developing unit 201. When the developing unit 201 is set in the printer 200, the photoconductive-drum gear 204 engages with the driving gear 202 of the printer 200 to transmit the driving force from the printer 200 to the developing unit 201. As shown in FIG. 14, the diameter of the photoconductive-drum gear 204 is larger than the diameter of the photoconductive drum 203. Consequently, when the developing unit 201 is set in the printer 200, the photoconductive-drum gear 204 partially juts from the bottom plate of the developing unit 201 serving as a part of the paper-transporting passage way. In the conventional printer 200, since the width of the printing paper is narrower than the width of the photoconductive drum 203, and the photoconductive drum gear 204 juts outside the printing-paper passage area, the photoconductive-drum gear 204 does not become an obstacle to the passage of the printing paper. However, when the developing-unit guide 14 having the plurality of the developing units 2 is set in the printer 1 as shown in FIG. 1, if the developing units 2 have the same geometry as the conventional developing unit 201, some the photoconductive-drum gears of the plurality of the developing units 2 will become obstacles to the passage of the printing paper since they will jut within the printing-paper passage area. Accordingly, the geometry of the developing units 2 for use in the printer 1 of the first embodiment is different from that of the conventional developing unit 201.

Figure 15:
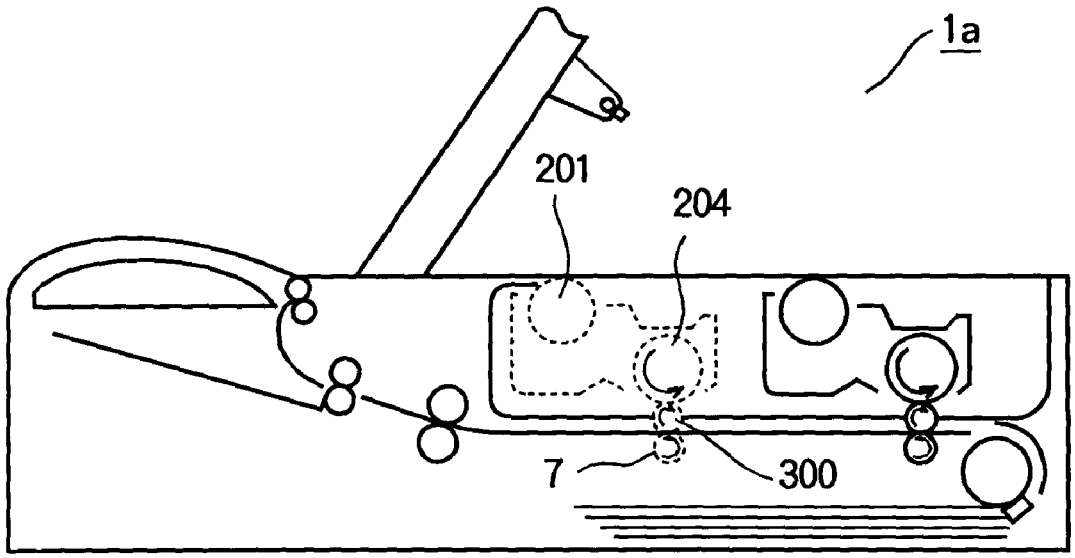
FIG. 15 is a sectional view of an image forming apparatus of a second embodiment according to the invention.
Figure 16:
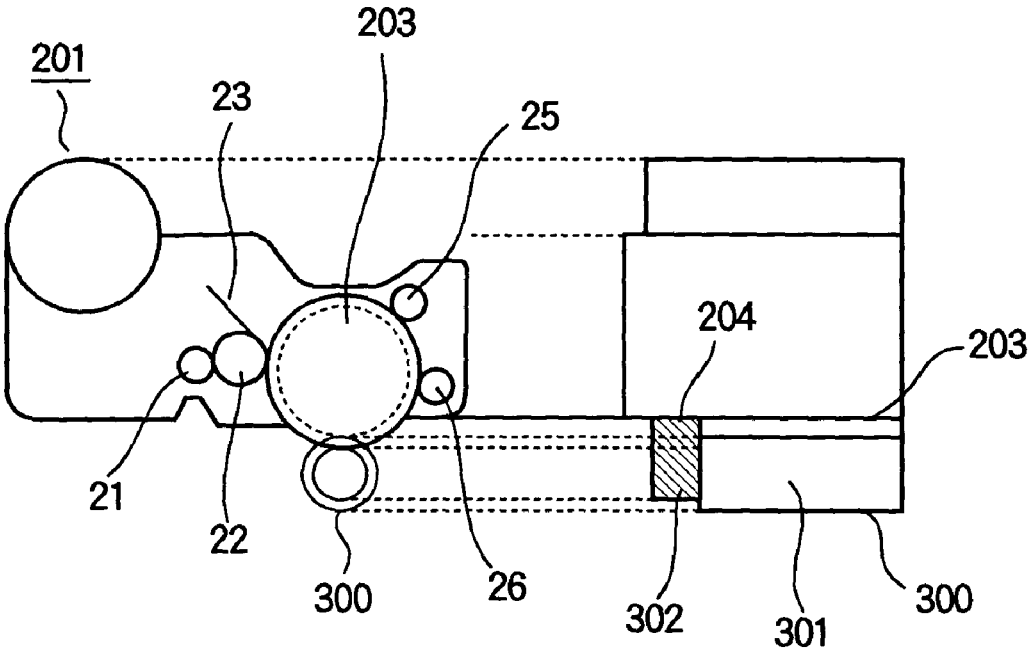
FIG. 16 is an explanatory view for explaining relationship between an intermediate transferring roller provided in a developing-unit guide and a photoconductive-drum gear of a developing unit for use in the image forming apparatus of the second embodiment.
Figure 17:
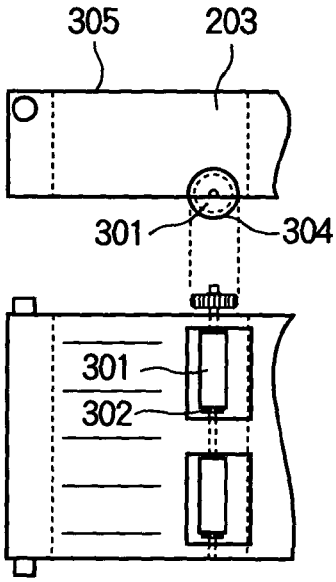
FIG. 17 shows a part of a cross section and a part of a bottom of a developing-unit guide of the image forming apparatus of the second embodiment.

The printer 1*a* of the second embodiment that can use the conventional developing units 201 will now be described with reference to FIGS. 15 to 17. Unlike the developing-unit guide 14 of the printer 1 of the first embodiment, a developing-unit guide 305 of the printer 1*a* of the second embodiment is provided with an intermediate transferring member including an intermediate transferring roller 300 with a driving gear 302 that does not become an obstacle to the passage of the printing paper in transmitting the driving force to the developing guides. FIG. 15 is a sectional view of the printer 1*a* of the second embodiment. FIG. 16 is an explanatory view for explaining relationship between the intermediate transferring roller 300 of the developing-unit guide 305 and the photoconductive-drum gear 204 of the developing unit 201. FIG. 17 shows a part of the cross section and a part of the bottom of the developing-unit guide 305.

As shown in FIG. 17, the intermediate transferring roller 300 is provided within the developing-unit storing section of the developing-unit guide 305. When the developing unit 201 is set in the developing-unit guide 305, the intermediate transferring roller 300 faces the photoconductive drum 203 as shown in FIG. 16. The intermediate transferring roller 300 partially juts from the bottom of the developing-unit guide 305 to face the transferring roller 7 of the printer 1*a* as shown in FIG. 15. The intermediate transferring roller 300 comprises the driving gear 302 and a intermediate transferring section 301. The diameter of the driving gear 302 is smaller than that of the intermediate transferring section 301. When the driving gear 302 engages with the photoconductive-drum gear 204, the intermediate transferring section 301 comes into contact with the surface of the photoconductive drum 203. The intermediate transferring roller 300 is applied with a voltage of a polarity opposite to that of the charged toner as with the photoconductive drum 203 and the transferring roller 7. However, the absolute value of the voltage applied to the intermediate transferring roller 300 is larger than that of the voltage applied to the photoconductive drum 203 and is smaller than that of the voltage applied to the transferring roller 7. Consequently, the toner image formed on the photoconductive drum 203 is transferred to the intermediate transferring section 301 of the intermediate transferring roller 300 temporarily, and after that it is transferred to the printing paper being transported from the transferring section 301.

The printer 1*a* of the second embodiment can be provided at even lower cost since it does not use an expensive large-size photoconductive drum, and its uses off-the-shelf developing units 2.

A Variant of the Second Embodiment

Figure 18:
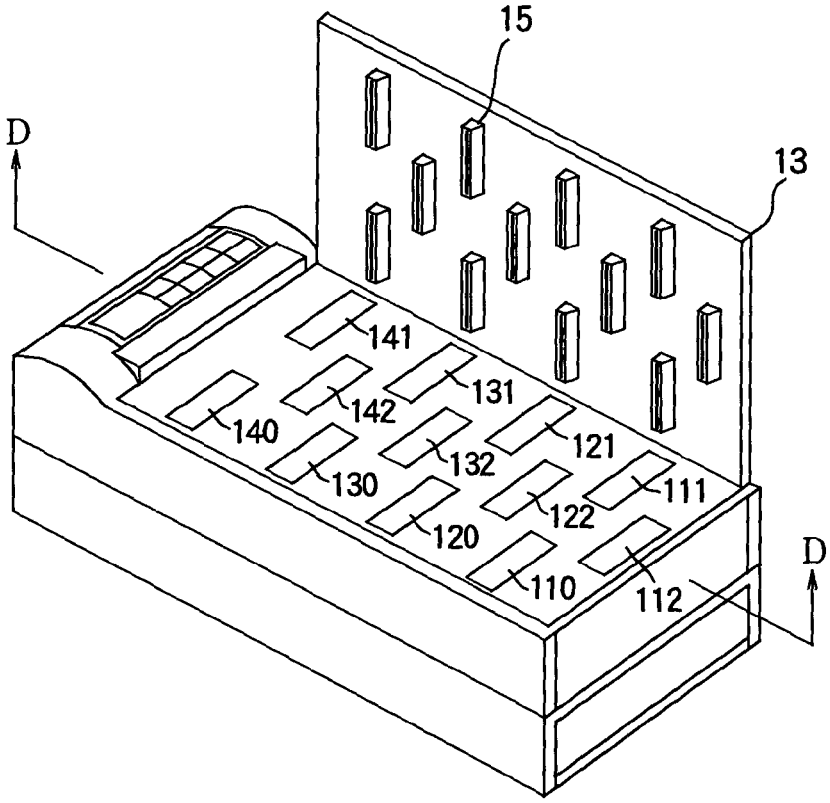
FIG. 18 is a perspective view of a variant of the image forming apparatus of the second embodiment.
Figure 19:
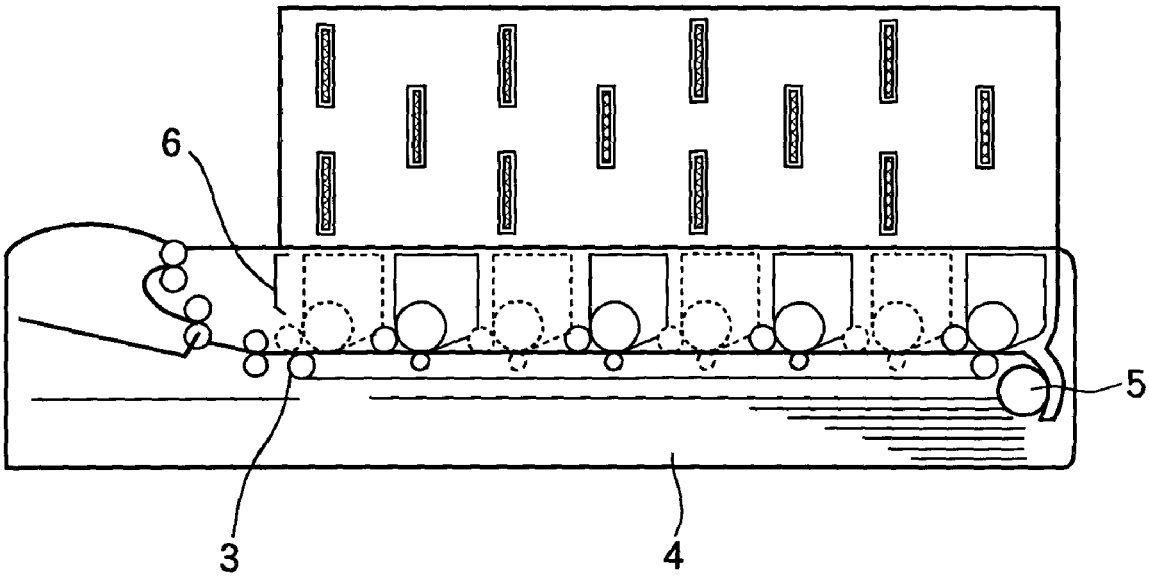
FIG. 19 is a cross sectional view of the variant of the image forming apparatus of the second embodiment.

The printer 1*a* of the second embodiment may be a color printer. The color printer as the variant of the second embodiment includes a plurality of the developing units in a staggered configuration for each color as shown in FIG. 18. In FIG. 18, the developing units 110, 111, 112 assume a yellow image development, the developing units 120, 121, 122 assume a magenta image development, the developing units 130, 131, 132 assume a cyan image development, and the developing units 140, 141, 142 assume a black image development, for example. These developing units are disposed so as to face the printing paper passageway 3 as shown in FIG. 19.

A THIRD EMBODIMENT

In the foregoing first and second embodiments, the developing units 2*a*, 2*b* and 2*c* transfer their respective toner images onto the same printing paper, so if they are displaced from their right positions, there arises slippage between the toner images transferred onto the same printing paper (referred to as "image slippage" hereinafter) which degrades the quality of the image formed on the printing paper. Such image slippage is caused by displacement of the LED head 64 in the paper-transporting direction (auxiliary scanning direction) or in the main scanning direction (cross feed direction), or by inclination of the LED head 64 to the main scanning direction. The printer 1*b* of the third embodiment described below is capable of removing the image slippage due to the inclination of the LED head 64 to the main scanning direction and the displacement of the LED head 64 in the main and auxiliary scanning directions by carrying out correction on the image data to compensate for the inclination and displacement of the LED head 64.

Figure 20:
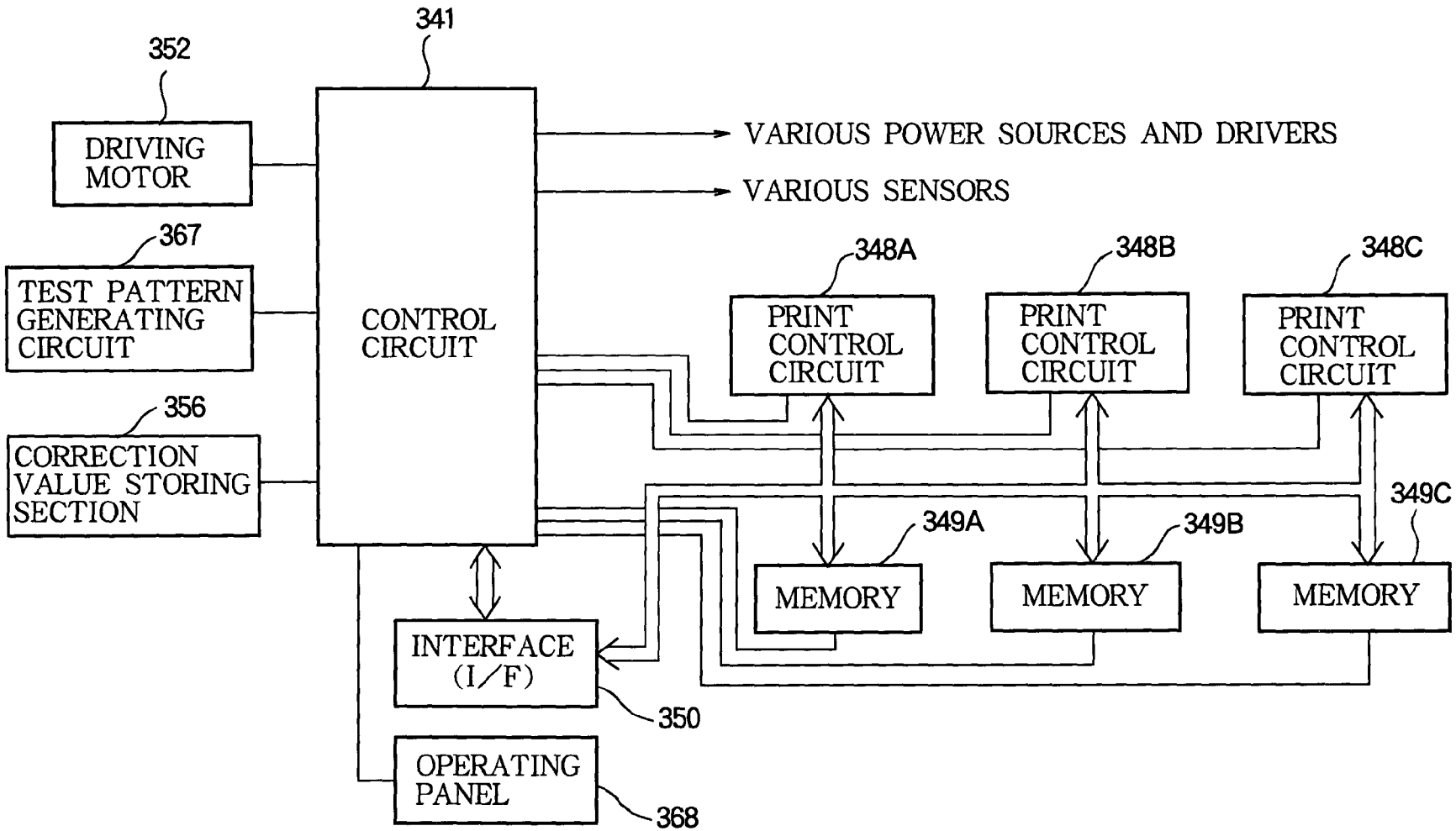
FIG. 20 is a block diagram showing a structure of a control unit of a printer of a third embodiment.
Figure 21:
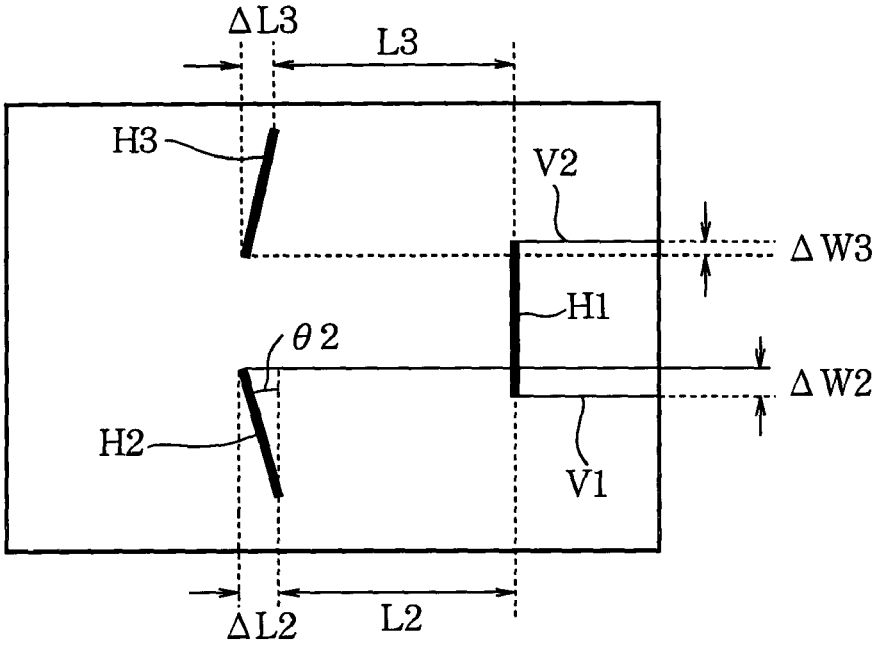
FIG. 21 shows a test pattern generated by a test pattern generating circuit of the printer of the third embodiment.

FIG. 20 is a block diagram showing a structure of a control unit of the printer 1*b* of the third embodiment. The printer 1*b* is configured to write a test pattern as shown in FIG. 21 generated by a test pattern generating circuit 367 into memories 349A, 349B, and 349C through an interface circuit 350 when a control circuit 341 detects a test switch in an operating panel 368 to be pressed. In consequence, the image of the test pattern is printed on the printing paper. How the image of the test pattern is printed is explained below with reference to FIG. 21.

The correction on the image data to compensate for the inclination and displacement of the LED head 64 can be carried out at any one of a predetermined number of different levels respectively. For example, in a case where the correction is possible at one of eleven different levels, the middle one of the eleven levels, that is, the sixth level (neutral level) is set as the correction level for a start. A correction value storing section 356 stores correction values corresponding to the eleven levels. The control circuit 341 sends the test pattern from the memories 349A, 349B, and 349C to print control circuits 348A, 348B, 348C, thereby the test pattern as shown in FIG. 21 is printed. In FIG. 21, H1, H2, H3 denote straight lines approximately parallel to the main scanning direction printed by driving all the LEDs on the same line of the LED head 64 at a time to form dots when the printing paper is pinched between the photoconductive drums 24 of developing units 2*a*, 2*b*, 2*c* and their respective transferring rollers so that latent images are formed on the photoconductive drums 24 by having the toner adhere to the latent images, transferring the toner images to the printing paper by the transferring rollers, and fixing the toner images by the fixing roller of the fixing section 8.

The horizontal line H1 is printed by the first developing unit 2*a*, The horizontal line H2 is printed by the second developing unit 2*b*, and the horizontal line H3 is printed by the third developing unit 2*c*. It is possible to determine the positioning error (the displacement and the inclination) of the developing units 2*a*, 2*b*, 2*c* from these lines H1 to H3. In the example shown in FIG. 21, the line H2 printed by the second developing unit 2*b* is distant by L2 from the line H1 printed by the first developing unit 2*a*, and is inclined such that its right end is displaced upward by ΔL2 with respect to the line H1. On the other hand, the line H3 printed by the third developing unit 2*c* is distant by L3 from the line H1, and is inclined such that its left end is displaced upward by ΔL3 with respect to the line H1. From the values of the above L2, ΔL2, L3, ΔL3, the distance between the second developing unit 2*b* and the first developing units 2*a*, the distance between the third developing unit 2*c* and the first developing units 2*a*, and the inclinations of the second and third developing units 2*b*,2*c* with respect to the first developing unit 2*a* can be determined. V1 in FIG. 21 denotes a straight line printed by continuously driving only the leftmost LED of the LED head 64 of the first developing unit 2*a*. It is evident that the second developing unit 2*b* is displaced rightward by ΔW2 with respect to the first developing unit 2*a* from the distance ΔW2 between the right end of the line V1 and the right end of the line H2. It is also evident that the third developing unit 2*c* is displaced leftward by ΔW3 with respect to the first developing unit 2*b* from the distance ΔW3 between the left end of the line V2 and the left end of the line H3. As described above, it is possible to determine the positioning error of the developing units 2*a*, 2*b*, 2*c* by printing the test pattern as shown in FIG. 21. If the user selects an appropriate level from the eleven levels for each of the inclination correction and displacement correction in accordance with the values of L2, L3, ΔL2, ΔL3, ΔW2, ΔW3, an image free from image slippage can be obtained.

Figure 23A:
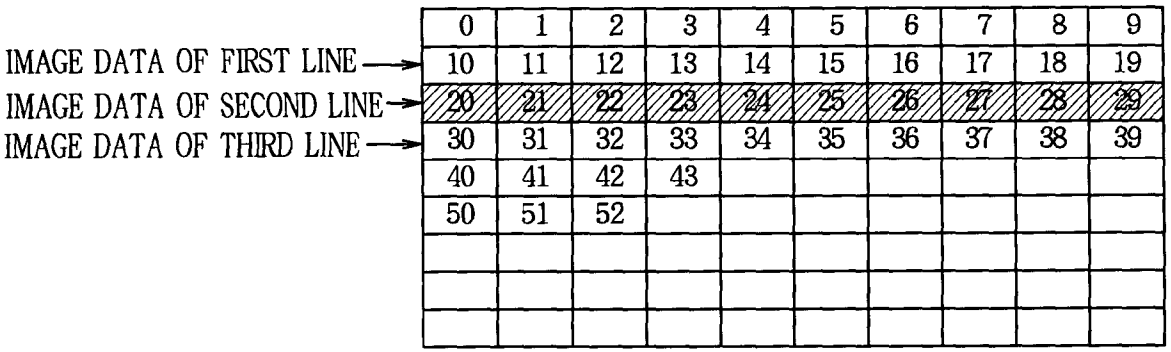
FIG. 23(*a*) and FIG. 23(*b*) show image data arrangements within a memory for explaining how the correction is carried out when the right end of the LED head is displaced upward.
Figure 23B:
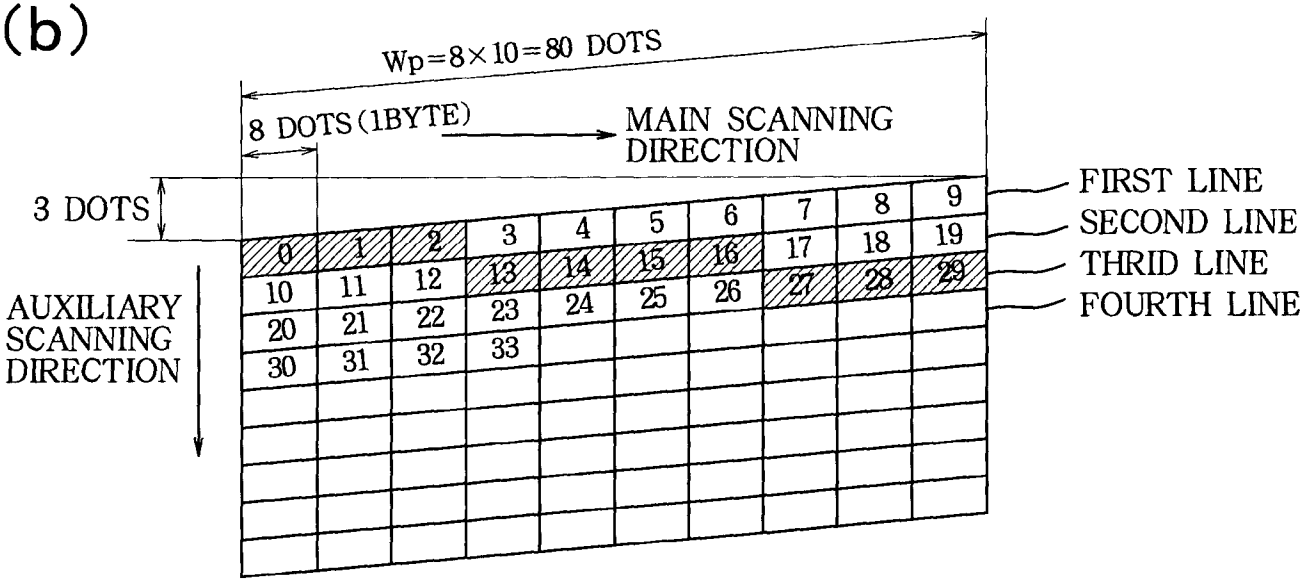

The operation of the printer 1*b* for correcting the displacement of the LED head in the auxiliary scanning direction and the inclination of the LED head to the main scanning direction will be explained in detail with reference to FIGS. 21, 23 and 24. FIG. 23(*a*) and FIG. 23(*b*) are explanatory views for explaining how the correction is carried out when the right end of the LED head is displaced upward. When the second developing unit 2*b* is inclined with respect to the first developing unit 2*a* by $\theta 2=\sin^{-1}(\Delta L2/W)$, so the line H2 is inclined as shown in FIG. 21, if the image data is sent to the LED head 64 of the second developing unit 2*b* as it is without any correction, the image printed by this second developing unit 2*a* is inclined by θ2 with respect to the image printed by the first developing unit 2*a*, and these printed images therefore do not join accurately. Accordingly, there arises a blank area between these images, or these images overlap partially. In the above explanation, W denotes the number of dots (the number of LEDs) on the same line of the LED head 64, and the distance ΔL2 is expressed in dots. First, explanation will be given to the case where the right end of the line H2 is displaced upward with respect to the line H1.

In order to facilitate the explanation, assume that the number of dots lined in the main scanning direction Wp equals to 80, and the inclination of the line H1 (ΔL2) equals to 3 dots. FIG. 23(*a*) is an explanatory view for explaining how the image data is arranged in array within the memory 349A. The numerals within the squares denote addresses in the memory 349A. FIG. 23(*b*) is an explanatory view for explaining how the LED head 64 reads the image data from the memory 349A in printing the image. The LED head 64 is inclined by three dots for the printing width Wp (=80 dots). When the LED head 64 has written a line of the image data, or formed a line of latent image, the printing paper is fed by a certain amount, and then the LED head 64 writes the next line. The LED head 64 writes the first, second, and subsequent lines in succession in this manner. Blank data is written to the first row including addresses 0 to 9 and the second row including addresses 10 to 19 in the memory 349A in advance. The first line of the image data is written to the third row including addresses 20 to 29, the second line of the image data is written to the fourth row including address 30 to 39, and the third line of the image data is written to the fifth row including addresses 40 to 49. Thus, the image data is written orderly to the rows of the memory 349A as shown in FIG. 23(*a*). In FIG. 23(*a*), the first line of the image data is written to the diagonally shaded squares. If each line of the image data is split into three parts and the parts are written to three consecutive rows as shown in FIG. 23(*b*), the discrepancy of ΔL2 between the line H2 printed by the second developing units 2*b* and the line H1 printed by the first developing unit 2*a* is within one dot.

Accordingly, the second developing unit 2*b* initiates forming a latent image just after the first developing unit 2*b* forms L2 lines of a latent image modifying the image data arrangement as shown in FIG. 23(*b*), whereby the images printed by the first and second developing units align with an accuracy of one line. Thus, the discrepancy between the images printed by the first and second developing units 2*a*, 2*b* respectively can be reduced to within one line. The timing in which the second developing unit 2*b* initiates forming the latent image can be adjusted accurately by setting the number of revolutions of a driving motor 352 for driving the developing units to an appropriate value in accordance with the distance L2.

Figure 24A:
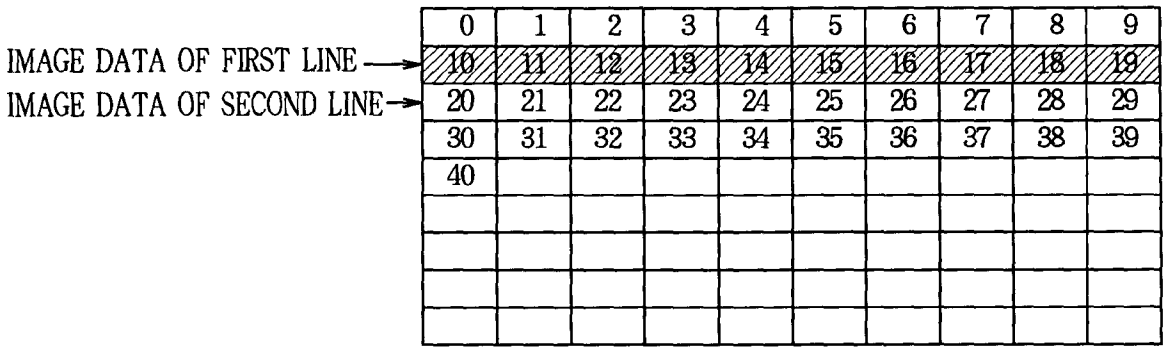
FIG. 24(*a*) and FIG. 24(*b*) show image data arrangements within a memory for explaining how the correction is carried out when the left end of the LED head is displaced upward.
Figure 24B:
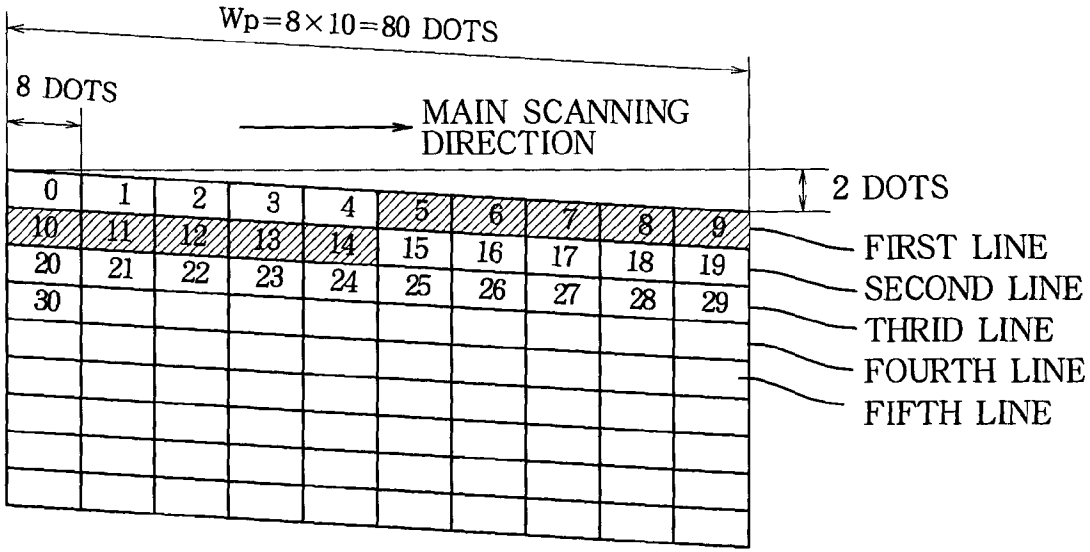

FIGS. 24(*a*) and 24(*b*) are explanatory views for explaining how the correction is carried out when the left end of the LED head is displaced upward by two dots. However, explanation thereof is omitted since it is easily deduced how the correction is carried out from the above explanation.

Figure 22:
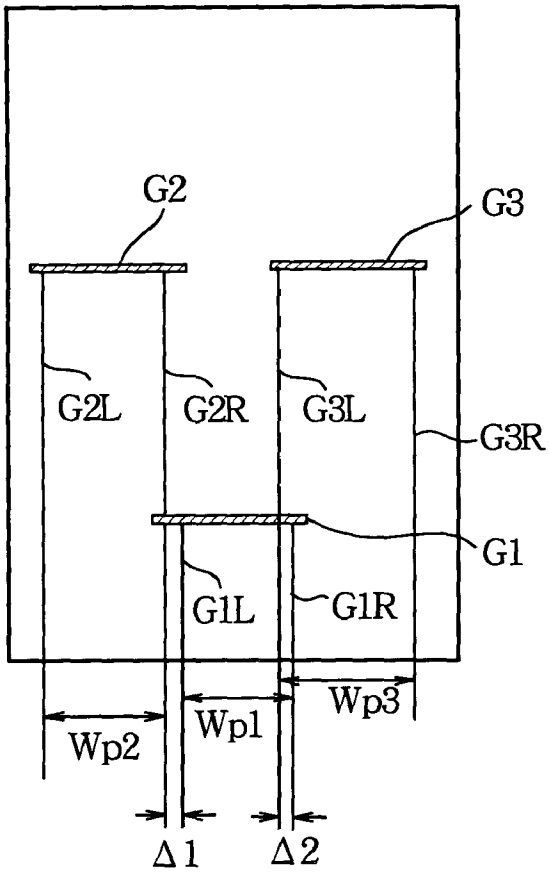
FIG. 22 shows a test pattern generated by the test pattern generating circuit of the printer of the third embodiment.

Next, explanation will be given to the case where the LED head is displaced in the main scanning direction. The control circuit 341 sends the test pattern generated by the test pattern generating circuit 367 from the memories 349A, 349B, 349C to the print control circuits 348A, 348B, 348C as with the foregoing case, thereby printing the test pattern shown in FIG. 22. In FIG. 22, G1, G2 and G3 denote horizontal lines printed by driving all the LEDs of the LED heads of the first, second and third developing units 2*a*, 2*b*, 2*c*. G1L and G1R denote straight lines parallel to the auxiliary scanning direction printed by driving LEDs situated at the right and left ends of the LED head of the first developing unit 2*a* each of which is Wp/2 distant from the center of this LED head. G2L and G2R denote straight lines parallel to the auxiliary scanning direction printed by driving LEDs situated at the right and left ends of the LED head of the second developing unit 2*b* each of which is Wp/2 distant from the center of this LED head. G3L and G3R denote straight lines parallel to the auxiliary scanning direction printed by driving LEDs situated at the right and left ends of the LED head of the third developing unit 2*c* each of which is Wp/2 distant from the center of this LED head. The displacements of the developing units 2*a*, 2*b*, 2*c* can be determined from these straight lines. In the case shown in FIG. 22, the line G2 is displaced leftward by Δ1 with respect to the line G1, and the line G3 is displaced leftward by Δ2 with respect to the line G1. From the values of Δ1 and Δ2, it is possible to determine the displacements of the second and third developing units 2*b*, 2*c* with respect to the first developing unit 2*a*.

Figure 25A:
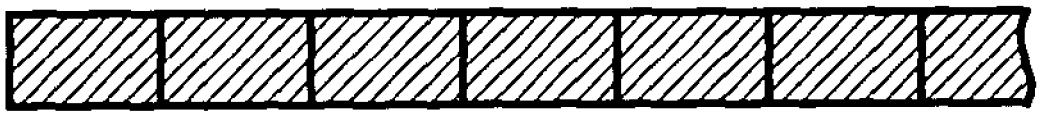
FIG. 25(*a*) and FIG. 25(*b*) show image data arrangements within a memory for explaining how the correction is carried out when the LED head is displaced in the main scanning direction.
Figure 25B:
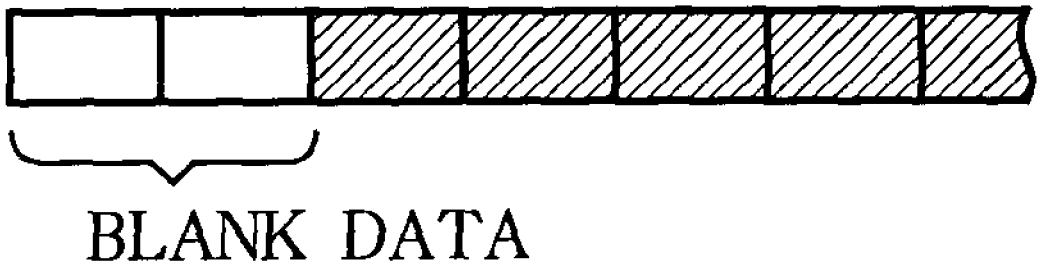

The correction of the image data for compensating for the image slippage due to the displacements of the developing units in the main scanning direction can be done at any level selected from different levels as is the case with the previously-described correction of the image data for compensating for the image slippage due to the displacements of the developing units in the auxiliary scanning direction. That is, as shown in FIG. 25, upon receiving the image data, the printer 1*b* of this embodiment clears the memory and writes blank data to addresses determined based on the selected correction level, and then writes the image data so that the image data is shifted to compensate for the above-described Δ1 and Δ2. By reading the shifted image data from the memory and sending it to the LED heads, the LED heads can form latent images corrected in the main scanning direction. FIG. 25(*a*) shows an arrangement of the image data as received, and FIG. 25(*b*) shown an arrangement of the image data that has been shifted.

As described above, the printer 1*b* of the third embodiment includes a plurality of developing units 2*a*,2*b*,2*c* each of which includes a writing head 64; a memory means 349A,349B, 349C for storing image data arranged in an array for each of the plurality of developing units; means 356 allowing to select one of different levels at which the image data is corrected for compensating for displacement and inclination of at least one of the plurality of developing units with respect to reference one of the plurality of developing units; and a control means 348A,348B,348C for modifying an arrangement of the image data within the memory means in accordance with the selected level. Therefore with the printer of the third embodiment, the image slippage due to the inclination of the LED head to the main scanning direction and the displacement of the LED head in the main and auxiliary scanning directions can be easily removed.

The above explained preferred embodiments are exemplary of the invention of the present application which is described solely by the claims appended below. It should be understood that modifications of the preferred embodiments may be made as would occur to one of skill in the art.

What is claimed is:

1. An image forming apparatus comprising:

a plurality of removable developing units each of which has an image carrier whose width is narrower than a width of a printable area of a printing medium; and a driving unit for driving the plurality of the removable developing units;

the plurality of the removable developing units being disposed in different rows, each row extending in a longitudinal direction at least substantially perpendicular to a main scanning direction such that one end of an image producing area of an image carrier of a first developing unit coincides with one end of an image producing area of an image carrier of a second developing unit adjoining to the first developing unit;

the image forming apparatus further comprising a control unit for supplying printing data to the plurality of the removable developing units in timings shifted from row to row.

2. An image forming apparatus according to claim 1, in which the plurality of the developing units are installed in a developing-unit guide.

3. An image forming apparatus according to claim 2, in which the developing-unit guide is installed in a main body of the image forming apparatus so as to be rotatable about a shaft fixed to the main body and pivoting one end of the developing-unit guide.

4. An image forming apparatus according to claim 2, in which the developing-unit guide is removable from a main body of the image forming apparatus.

5. An image forming apparatus according to claim 2, in which a bottom plate of the developing-unit guide serves as a part of a printing media transporting passageway.

6. An image forming apparatus according to claim 5, in which the bottom plate of the developing-unit guide is provided with ribs parallel to a printing media transporting direction.

7. An image forming apparatus according to claim 1, in which each of the plurality of the removable developing units is a color developing unit.

8. An image forming apparatus according to claim 1, in which the plurality of the removable developing units are situated over a printing media transporting passageway within a main body of the image forming apparatus.

9. An image forming apparatus according to claim 1, in which the plurality of the removable developing units are situated over an intermediate transferring unit within a main body of the image forming apparatus.

10. An image forming apparatus, comprising:

a first developing section and a second developing section that are aligned such that a print medium advances in a first direction through said first and second developing sections in sequence;

a first image bearing body accommodated in said first developing section and extending in a second direction substantially perpendicular to the first direction, said first image bearing body being shorter than a dimension of the print medium in the second direction; and a second image bearing body accommodated in said second developing section and extending in a third direction substantially perpendicular to the first direction, said second image bearing body being shorter than a dimension of the print medium in the third direction;

wherein the first and second image bearing bodies are staggered with respect to each other such that one of the first and second image bearing bodies is displaced ahead of the other of the first and second image bearing bodies in a fourth direction substantially perpendicular to the first direction, and such that a first image formed by said first image bearing body on the print medium and a second image formed by said second image bearing body on the print medium are aligned in the fourth direction and are contiguous with each other to form a complete image.

* * * * *